US005226565A

United States Patent [19]

Hladis et al.

[11] Patent Number: 5,226,565

[45] Date of Patent: Jul. 13, 1993

[54] CLEANING ATTACHMENT FOR NOZZLES

[75] Inventors: Alan Hladis, Akron; John J. Tichy, Jr., Hudson; Michael R. Griffin, Akron, all of Ohio

[73] Assignee: The Dow Chemical Company, Midland, Mich.

[21] Appl. No.: 742,138

[22] Filed: Oct. 7, 1991

[51] Int. Cl.[5] ..... B67D 5/60

[52] U.S. Cl. ..... 222/145; 222/148; 239/112

[58] Field of Search ..... 222/145, 148; 239/112, 239/113

[56] References Cited

U.S. PATENT DOCUMENTS

| | | | |
|---|---|---|---|
| 3,375,978 | 4/1968 | Rennie | 239/113 |
| 3,690,557 | 9/1972 | Higgins | 239/112 |
| 3,842,680 | 10/1974 | Vollick et al. | 222/148 X |
| 3,873,023 | 3/1975 | Moss et al. | 239/112 X |
| 3,876,144 | 4/1975 | Madden et al. | 239/106 |
| 4,036,434 | 7/1977 | Anderson et al. | 239/8 |
| 4,200,232 | 4/1980 | Fraley et al. | 239/112 |
| 4,262,848 | 4/1981 | Chabria | 239/112 |
| 4,534,802 | 8/1985 | Gates et al. | 134/22.12 |
| 4,554,942 | 11/1985 | Williams et al. | 222/148 X |
| 4,557,957 | 12/1985 | Manniso | 428/461 X |
| 4,621,026 | 11/1986 | Robinson | 428/461 X |
| 4,838,325 | 6/1989 | Bordini | 141/90 |
| 4,844,348 | 7/1989 | Rutz | 239/113 X |
| 4,898,327 | 2/1990 | Sperry et al. | 239/1 |
| 4,913,317 | 4/1990 | Wernicke | 222/1 |

*Primary Examiner*—Andres Kashnikow
*Assistant Examiner*—Joseph A. Kaufman

[57] ABSTRACT

A nozzle attachment (10) for cleaning residual material from a mixhead pour nozzle (16) having a cylindrical body (17) terminating in an end face with an axial bore (20) receiving a plunger (23) including, a sleeve (30) positioned outwardly of the cylindrical body forming a plenum chamber (52), ports (40, 41) in the sleeve communicating the plenum chamber with a source of pressurized fluid (70), and a cap (60) positioned circumferentially of the end face of the pour nozzle and providing an annular substantially radially inwardly directed orifice (65) communicating with the plenum chamber for directing pressurized fluid inwardly across the end face of the pour nozzle to remove residual material therefrom. A pressurized air supply system (70) provides air at different pressures to the nozzle attachment at selected times during the operating cycle of the mixhead pour nozzle.

21 Claims, 4 Drawing Sheets

CLEANING ATTACHMENT FOR NOZZLES

TECHNICAL FIELD

The present invention relates to an attachment for cleaning a nozzle employed in the dispensing of resins in molding operations. More particularly, the present invention relates to an attachment affixed to a nozzle for intermittently dispensing resins which cleans residual resin from the nozzle. More specifically, the present invention relates to a blow-off attachment affixed to a nozzle for intermittently dispensing resins having an extent of adhesive tendency which cleans residual resin from the nozzle.

BACKGROUND ART

There are a variety of plastic parts or products or components thereof which are made by depositing or pouring a resin into an open mold configuration. For this purpose, dispensers have been developed which combine the necessary chemicals for the particular application in a mixhead. In addition to a mixhead body where the requisite chemicals are combined, the mixhead is provided with a mixhead pour nozzle which dispenses a metered quantity of the combined chemicals into an open mold during each pouring cycle of the molding process.

In a great many instances, it is possible to effect a pour cycle without encountering problems in the retention and build-up of chemicals at the outlet of a mixhead pour nozzle. This may be accomplished through a number of approaches. The design of the mixhead pour nozzle and the mixhead plunger operative therein may be significant in achieving a pour cycle without residual chemicals remaining on or building up on the mixhead pour nozzle. In other instances, the selection and compounding of the chemicals employed in the molding process may be tailored such that tendencies for adhesion of the chemicals and the resultant build-up is largely eliminated or sufficiently reduced such as not to present a problem with respect to the necessity for cleaning residual chemicals from the mixhead pour nozzle.

In some instances, build-up of a molding chemical on a mixhead pour nozzle cannot be controlled by the chemicals employed or the design of the mixhead or the mixhead pour nozzle alone. For example, in certain applications involving the reaction injection molding of urethane foams, the compounded foam as emitted from the mixhead pour nozzle has a tacky, adhesive quality which promotes adherence to and build-up of the foam on the mixhead pour nozzle such as to require cleaning on an extremely frequent basis to maintain proper operation of the mixhead pour nozzle.

The creation of a tacky or adhesive quality of the foam may result from a number of factors. For example, some water-blown foams tend to produce a foam that at the time it is poured from the mixhead pour nozzle is relatively soft and tacky and which becomes very rigid in a relatively short period of time. Such foams are particularly susceptible to retention on a mixhead pour nozzle and rapid accumulation to the point of adversely interfering with the pouring operation of the nozzle. Foams having tacky adhesive qualities are also known to result from the use of certain polyols and additives. In some instances, the use of foams having such adhesive qualities is necessary to achieve a part or product having particular characteristics, despite the difficulties encountered with foam retention and build-up on a mixhead pour nozzle.

The prior art reflects a number of approaches to preventing the build-up of foams, sealing compounds, or other similar materials on various types of nozzle configurations. In some instances, various types of portable blow-off nozzles or air knives are used in the industry for cleaning, washing, and removing excess material from spray guns or other nozzle configurations. While perhaps suitable for intermittent cleaning operations, these devices have definite disadvantages and shortcomings in regard to materials, such as foams, having tacky, adhesive qualities. The manual use of blow-off nozzles or air knives is highly labor-intensive. In addition, the fixed mounting or manual directioning of air knives or blow-off nozzles has the disadvantage that it tends to blow the residual material on a nozzle laterally on the mold, often causing contamination of the fixtures, mold carriers, or related conveying systems which may be employed.

Another approach to the cleaning of nozzles involves basically the internal cleaning of the nozzle. In such instances, suitable valving is provided to direct air or a cleaning solvent through selected passages internally of the nozzle to follow at least a portion of the travel path of the resins and catalysts to clean the mixing chambers and passages internally of the nozzles. Besides the additional complexity, expense, and operational drawbacks of such internal cleaning apparatus, such may be ineffective to remove foam or other materials which may accumulate on the head of a nozzle located radially outwardly of an orifice therein.

There are also numerous examples of the use of blow-off nozzles which issue a jet of air that is generally circular in cross-section and parallel to the blow-off nozzle axis. Various types of direct and induced air flow have been provided to effect essentially a conical or annular air flow substantially paralleling the axis of the nozzle and positioned from a location radially proximate to or even displaced a distance from the nozzle. These devices, however, normally have little effectiveness in removing materials which are significantly adhered to a radial surface constituting the nose of the nozzle which is displaced proximate to or outwardly of the orifice therein. In addition, some of these devices may be prone to scattering material which may be displaced with an extent of contamination of surrounding elements. No single solution to the displacement of molding material adhered to a pour nozzle has eliminated all of the various disadvantages heretofore experienced in usage of the various devices employed in the prior art.

DISCLOSURE OF THE INVENTION

Therefore, an object of the present invention is to provide a blow-off attachment for a mixhead pour nozzle which is highly effective in removing foam that may adhere to the nozzle proximate the orifice therein. Another object of the present invention is to provide such an attachment which is operative during and subsequent to each pour cycle to effect a continual cleaning of the pour nozzle to thereby preclude a foam buildup which can adversely effect operating parameters of the mixhead pour nozzle. A further object of the present invention is to provide such an attachment which provides a high pressure flow of air directed across the nozzle substantially at the conclusion of each pouring cycle to displace residual foam from the pour nozzle and which provides a lower pressure air supply across the pour nozzle orifice at all other times in the operating cycle of the nozzle in order to keep the orifice clean, particularly during the foam shot when random foam dispersion can occur. Another object of the invention is to provide such an attachment which is especially designed to maintain both the mixhead pour nozzle and the attachment free of material buildup, even in the use of materials which possess tacky, adhesive characteristics.

Another object of the present invention is to provide an attachment for a mixhead pour nozzle which has a cap positioned circumferentially of the end surface of the pour nozzle and has an annular substantially radially inwardly directed orifice for delivering pressurized fluid inwardly across the end surface of the pour nozzle to remove residual material which tends to deposit and build up radially outwardly of the orifice on the end surface of the pour nozzle. Still another object of the present invention is to provide such an attachment wherein the annular substantially radially inwardly directed orifice tends to axially confine residual material displaced from the mixhead pour nozzle within the high pressure fluid emitted from the orifice. A further object of the present invention is to provide such an attachment wherein the orifice is directed at an angle of approximately 15° to a radial orientation, whereby the high pressure fluid emitted therefrom has a component of axial momentum so that the residual material which is initially confined proximate to the mixhead pour nozzle end surface is then substantially axially displaced away from the nozzle. Yet another object of the present invention is to provide such an attachment wherein displaced residual material is axially displaced by the pressurized fluid into an open mold being charged rather than being laterally deflected to the side of the mold, thereby causing possible contamination of the fixtures, mold carriers, or conveying system for the molds.

A further object of the present invention is to provide an attachment for a mixhead pour nozzle, including a plenum chamber which is configured to surround the nozzle and provide axisymmetric flow of fluid relative to the nozzle. A still further object of the present invention is to provide such an attachment which precludes the buildup of residual material on the pour nozzle but also is configured to minimize the retention and buildup of residual material on the attachment itself. Yet another object of the invention is to provide such an attachment which is of a two-part configuration that includes a cap which may be removed from the body of the attachment to effect any necessary cleaning of the attachment that may be required from time to time.

Another object of the present invention is to provide an attachment for a mixhead pour nozzle which may be adapted to a variety of mixheads and mixhead pour nozzles that are currently employed in the industry without the necessity for significant modification thereto. A further object of the present invention is to provide such an attachment which may be constructed of materials capable of readily withstanding abrasive cleaning techniques that may be employed in manufacturing facilities. A still further object of the invention is to provide such an attachment which reduces maintenance costs by eliminating the need for frequent manual cleaning of the pour nozzle orifice or the acquisition and operation of high-cost maintenance equipment, such as conventional air knives or blow-off nozzles.

At least one or more of the foregoing objects, together with the advantages thereof over known devices for cleaning residual material from a mixhead pour nozzle, which will become apparent from the specification that follows, are accomplished by the present invention.

In general, the present invention contemplates a nozzle attachment for cleaning residual material from a mixhead pour nozzle having a cylindrical body terminating in an end face with an axial bore receiving a plunger including a sleeve positioned outwardly of the cylindrical body forming a plenum chamber, ports in the sleeve means communicating the plenum chamber with a source of pressurized fluid, and a cap positioned circumferentially of the end face of the pour nozzle and providing an annular, substantially radially inwardly directed orifice communicating with the plenum chamber for directing pressurized fluid inwardly across the end face of the pour nozzle to remove residual material therefrom.

PREFERRED EMBODIMENT FOR CARRYING OUT THE INVENTION

Figure 1:
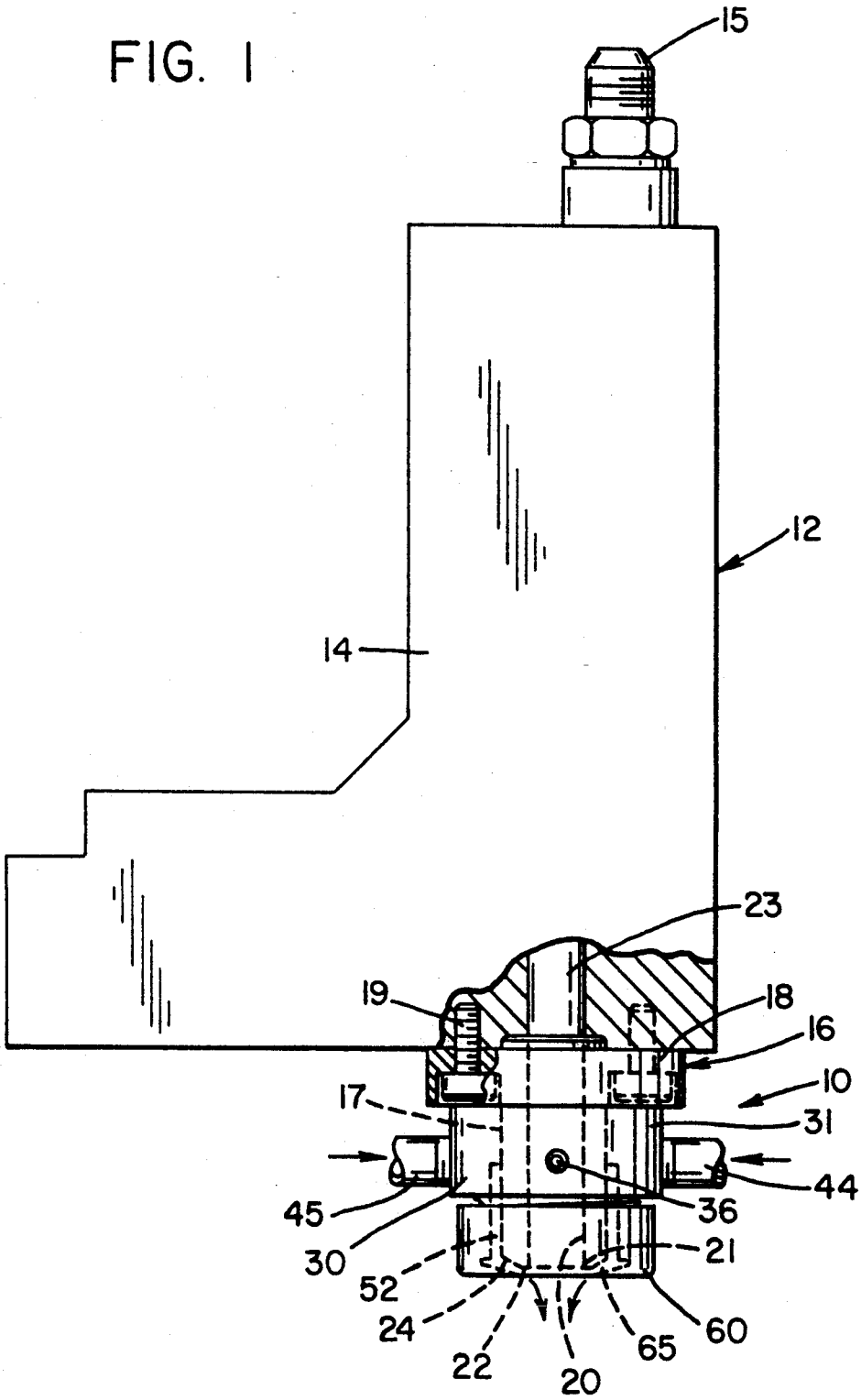
FIG. 1 is a side-elevational view with portions broken and in section of an exemplary blow-off attachment embodying the concepts of the present invention shown mounted in operative relation to a typical mixhead and mixhead pour nozzle for the dispensing of urethane foam.
Figure 2:
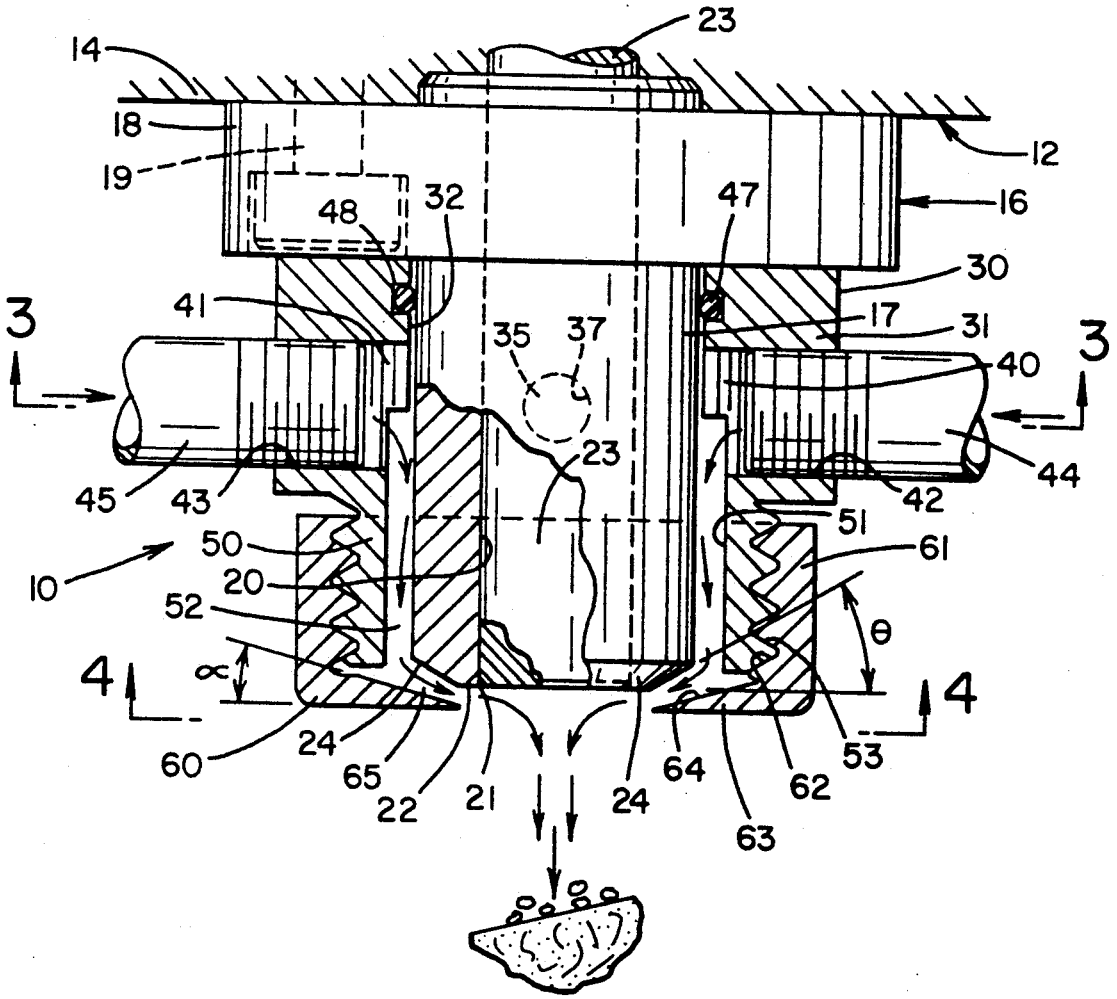
FIG. 2 is an enlarged fragmentary view of the blow-off attachment of FIG. 1 showing structural details thereof and details of the operational interrelationship with the mixhead pour nozzle and the mixhead plunger therein.

A nozzle attachment for cleaning residual material from a nozzle employed in a molding operation according to the concepts of the present invention is generally indicated by the numeral 10 in FIGS. 1 and 2 of the drawings. For exemplary purposes, the nozzle attachment 10 is shown in operative position in relation to a high pressure RIM mixhead assembly, generally indicated by the numeral 12, of a type employed for the dispensing of urethane foam.

As will be appreciated by persons skilled in the art, the mixhead assembly 12 shown in FIG. 1 of the drawings is a schematic depiction of a type having an L-shaped mixhead body 14 to which a plurality of component material inlet and return connectors and fluid actuating connectors are attached, such being exemplified by the connector assembly, generally indicated by the numeral 15. The various constituents of a particular urethane foam are suitably combined within the mixhead body 14 and transported to a mixhead nozzle, generally indicated by the numeral 16.

The mixhead nozzle 16 has a cylindrical barrel 17 designed to extend a distance from the mixhead body 14. The extremity of the cylindrical barrel 17 proximate to the mixhead body 14 has a cross block 18 which is affixed to the cylindrical barrel 17. The cross block 18 detachably secures mixhead nozzle 16 to the mixhead body 14, as by a plurality of fasteners 19, one of which is shown in a broken-away portion of cross block 18 in FIG. 1.

The cylindrical barrel 17 has a central through bore 20 which exits as an orifice 21 on the end face 22 of the barrel 17 of mixhead nozzle 16 (FIG. 2). The through bore 20 and orifice 21 supply urethane foam during the pour cycle of the mixhead assembly 12 in cooperation with the actuation of a clean-out plunger 23 which selectively reciprocally operates within the through bore 20. In the absence of the nozzle attachment 10 of the present invention, residual foam of certain types tends to adhere and build up on the end face 22 of mixhead nozzle 16, particularly circumferentially radially outwardly of the orifice 21. The extremity of the cylindrical barrel 17 of the mixhead nozzle 16 opposite the cross block 18 and radially outwardly of the end face 22 has a beveled surface 24 for a purpose to be described hereinafter. As shown, the beveled surface 24 is disposed at an angle $\theta$ of approximately 30 to a radial orientation, as seen in FIG. 2.

The nozzle attachment 10 is depicted in exemplary operational relationship to mixhead nozzle 16 in FIGS. 1–4 of the drawings. As shown, the nozzle attachment 10 includes a sleeve 30. The sleeve 30 has a body portion 31 which encompasses the barrel 17 of the mixhead nozzle 16. The body portion 31 has an inner surface 32 which is of a slightly larger diameter than the outer diameter of the barrel 17 of mixhead nozzle 16 and a larger diameter inner surface 51. The space between the barrel 17 and the inner surface 51 of the sleeve 30 forms an annular plenum chamber 52 which has a radial width which is preferably on the order of 0.06 to 0.07 of an inch.

Figure 3:
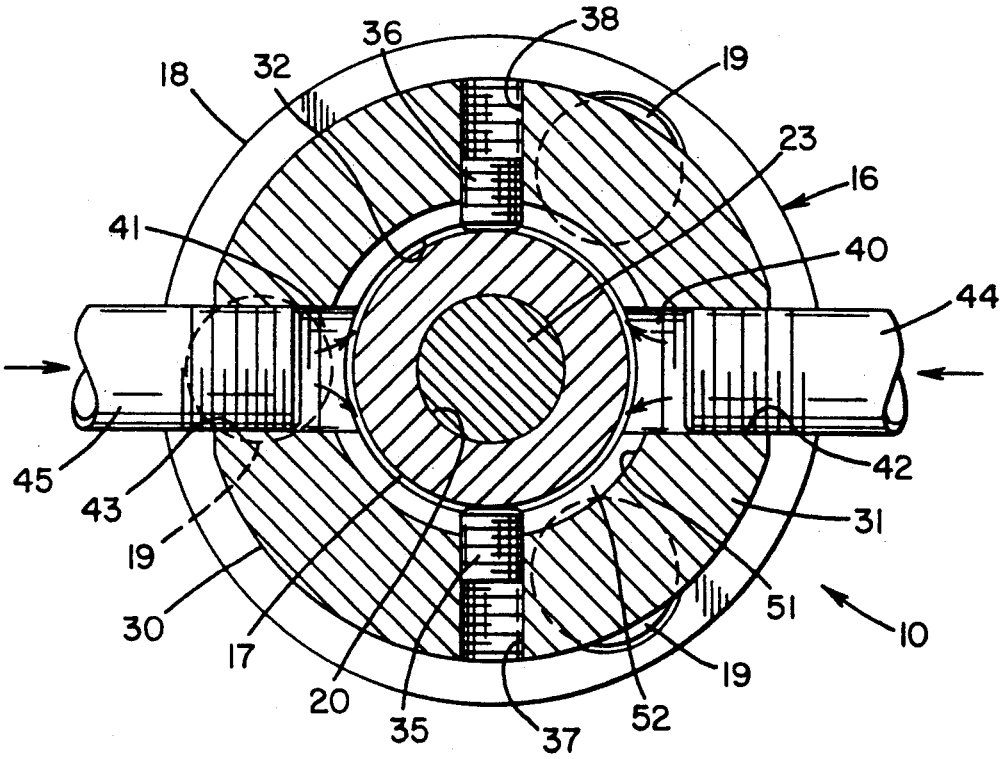
FIG. 3 is a sectional view taken substantially along the line 3—3 of FIG. 2 showing the interrelation between the ports supplying pressurized fluid to the blow-off attachment and an annular plenum chamber therein.
Figure 4:
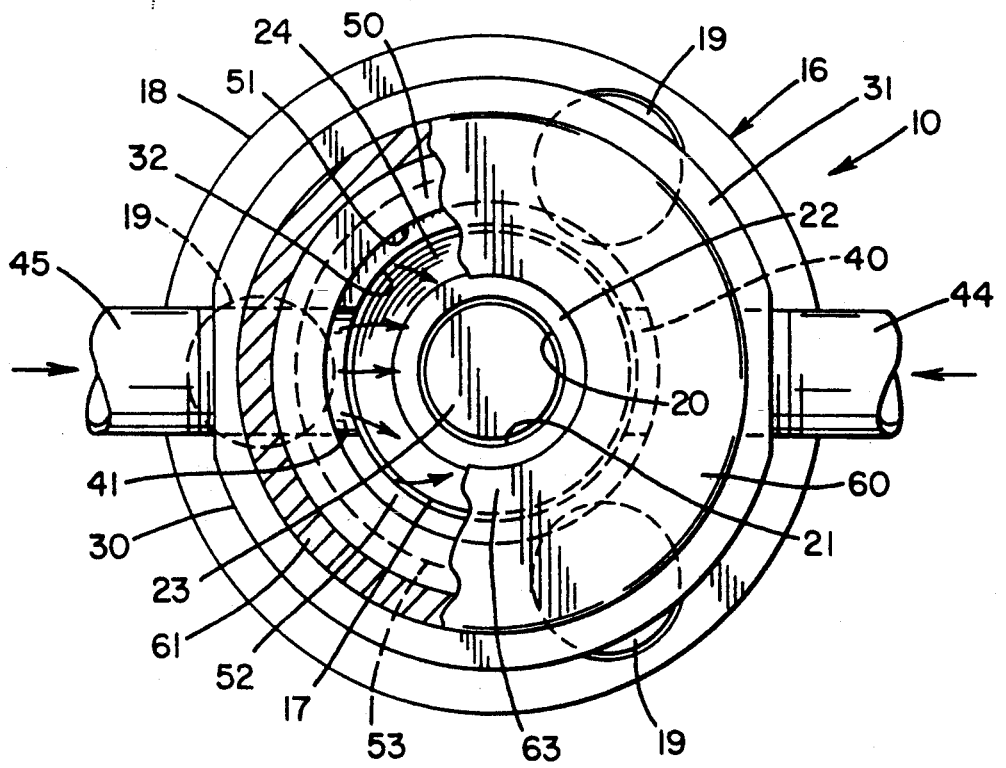
FIG. 4 is an end view of the blow-off attachment of FIG. 2 taken substantially along the line 4—4 of FIG. 2 depicting the interrelation between the blow-off attachment and the mixhead pour nozzle positioned therein.

The sleeve 30 is coaxially aligned with the barrel 17 and axially affixed thereon by a pair of set screws 35 and 36. As best seen in FIG. 3, the set screws 35 and 36 repose in a pair of diametrically opposite threaded bores 37 and 38, respectively, in the body 31 of sleeve 30. As shown, the set screws 35, 36 are threaded into bores 37 and 38 to a point of engagement with the barrel 17 of mixhead nozzle 16. The set screws 35, 36 are thus employed for adjusting the dimensions of the annular plenum chamber 52 and for affixing and removing sleeve 30 from the barrel 17.

The plenum chamber 52 formed between the body 31 of sleeve 30 and barrel 17 of mixhead nozzle 16 is supplied with fluid by virtue of a pair of ports 40 and 41 extending through the body 31 of sleeve 30. As shown, the ports 40, 41 may conveniently extend radially of the sleeve 30 and be located at diametrically opposed positions as seen in FIGS. 1–4. It will be appreciated that the combination of the annular plenum chamber 52 and the aforedescribed location of the ports 40, 41 serves to provide an axisymmetric flow of fluid in the annular plenum chamber 52 due to the orientation and location of the ports 40, 41. The ports 40, 41 may be provided with internal threads 42 and 43, respectively, to engage threaded connectors 44 and 45 communicating with a remote source of pressurized fluid in a manner described hereinafter. In order to preclude the loss of pressurized fluid upwardly in the sleeve 30 from the ports 40, 41, such that the flow of fluid is downwardly, the annular plenum chamber 52 is blocked upwardly of ports 40, 41. Blockage upwardly of the annular plenum chamber 52 may be readily effected by a conventional O-ring 47 positioned in a groove 48 in the inner surface 32 of the body portion 31 for engaging barrel 17 of mixhead nozzle 16, as best seen in FIG. 2.

The sleeve 30 has an axial projection 50 extending from the lower portion of the body 31. The inner surface 51 continues axial projection 50 forming a somewhat elongate plenum chamber 52 about the barrel 17 of the mixhead nozzle 16. The radial outer surface of at least a portion of the axial projection 50 is provided with threads 53 for a purpose to be described hereinafter.

The other component of the nozzle attachment 10, in addition to the sleeve 30, is a cap 60 which has an annular sidewall 61 that has threads 62 on the radially inner surface thereof for mating engagement with the threads 53 of the axial projection 50. The lower portion of the cap 60, which extends axially below the axial projection 50 as viewed in FIG. 2, has a generally radially inwardly directed lip 63. The lip 63 extends radially inwardly a distance such as to overlie a portion of the barrel 17 of mixhead nozzle 16 and preferably over all or a substantial portion of the beveled surface 24 and to or over a portion of the end face 22. As seen in FIG. 2, the lip 63 in its operative position is proximate to but spaced a slight distance axially from the end face 22 of barrel 17. It will be appreciated that, with the engagement of threads 62 of cap 60 with the threads 53 of axial projection 50, the axial position of the lip 63 may be controllably adjusted merely by rotation of the cap 60. The lip 63 preferably has an axially inside surface 64 which is tapered in that it is positioned at an angle $\alpha$ of approximately 15 to a radial orientation. It is, thus, to be observed that the inner surface 64 of lip 63 cooperates with the beveled surface 24 on end face 22 of the cylindrical barrel 17 to form a circumferential orifice 65 which is radially inwardly converging. It will, thus, be appreciated that pressurized fluid emitted from the orifice 65 is directed across the end surface 22 of the cylindrical barrel 17 of mixhead nozzle 16. While the directivity of the emitted fluid is substantially radially inwardly and, thus, converging centrally of orifice 21 of cylindrical barrel 17, the angularity of inside surface 64 of lip 63 of cap 60 gives the fluid a slight axial velocity component such that fluid dispensed from the orifice 65 removes any residual molding material from the surface of the cylindrical barrel 17, converges it radially centrally of the cylindrical barrel 17, and then displaces it axially of the mixhead nozzle 16, as is schematically depicted in FIG. 2 of the drawings. It will, thus, be appreciated that if the mixhead nozzle 16 is positioned to service an open mold, the residual material will be directed into the mold where it becomes part of the molded article, rather than being laterally deflected where deleterious contamination of fixtures, mold carriers, or related conveying systems by the residual material could occur.

The operational effectiveness and durability of the nozzle attachment 10 can be substantially enhanced by the selection of optimum materials for the sleeve 30 and the cap 60. No matter how effective the nozzle attachment 10 may be with respect to removing residual foam from the mixhead nozzle 16, the very nature of the pouring operation tends to cause airborne foam particles to eventually accumulate on nozzle attachment 10.

As a result, it will normally be necessary to intermittently disassemble the nozzle attachment 10 and clean the components thereof. This can normally be effected simply by removing the cap 60 from the sleeve 30 and individually cleaning the components and the mixhead nozzle 16. Since cleaning takes place in an industrial environment, it is advantageous that the materials of the nozzle attachment 10 be capable of withstanding relatively abrasive cleaning techniques and materials. While the sleeve 30 may be constructed of an appropriate aluminum or other metal, it is advantageous that the cap 60 be of steel. It is also advantageous to consider the use of a lubricous coating providing a low coefficient of friction that may advantageously be applied to the cap 60 and particularly to the inside surface 64 of the lip 63. With the use of a steel cap 60, coatings may be applied constituting a composite of electroless nickel and polytetrafluoroethylene which can be applied according to known processes, to produce a wear-resistant, anti-stick surface. The employment of such a coating, particularly on inner surface 64 of lip 63 of cap 60, or more extensively on cap 60, can greatly extend the time interval between instances where it is necessary to effect manual cleaning of the nozzle attachment 10.

Figure 5:
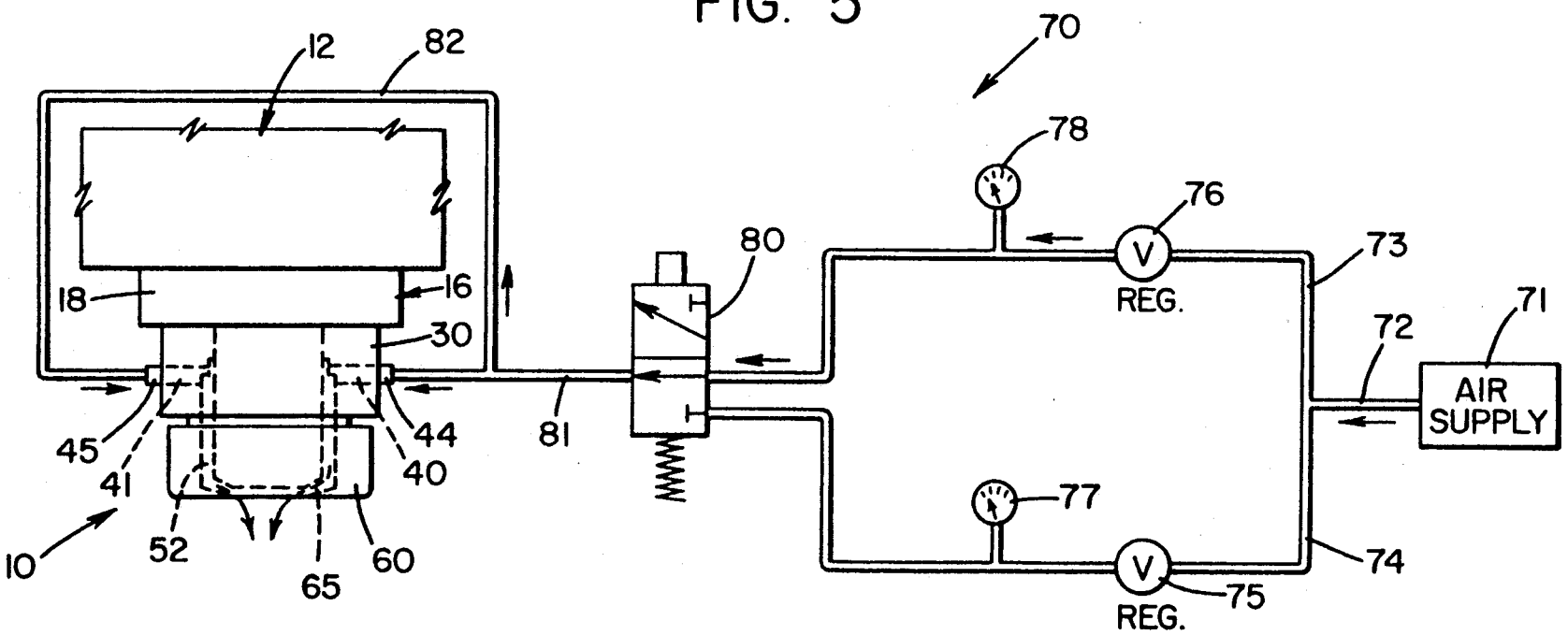
FIG. 5 is a schematic depiction of an air supply system for selectively supplying pressurized air to the blow-off attachment at selected pressures at selected times.

An air supply system for supplying fluid to the nozzle attachment 10 is generally indicated by the numeral 70 in FIG. 5. As shown, the air supply system 70 has an air supply 71 that provides a continuous supply of pressurized air which may be on the order of 80 psi or greater. Pressurized air is transported from the air supply 71 via high pressure air lines 72, 73, and 74 to a high pressure regulating valve 75 and a low pressure regulating valve 76. The output of the low pressure regulating valve 76 may be on the order of 20 psi and may be monitored by a suitable gauge 78. The output of the high pressure regulating valve 75 may be on the order to 80 psi and may similarly be monitored by a gauge 77. The output of the regulating valves 75, 76 may be supplied to a three-way, two-position air valve 80. The air valve 80 is timer-controlled to supply either 80 psi air or 20 psi air to the nozzle attachment 10.

The output of the air valve 80 is by way of an airline 81, which supplies the pressurized air to the connector 44 located at port 40 in the sleeve 30. A branch line 82 of airline 81 supplies pressurized air to the connector 45 in port 41 of the sleeve 30. Air valve 80 may conveniently be solenoid-controlled to establish a timing sequence for the supply of 20 psi or 80 psi in coordination with the operational timing sequence of the mixhead assembly 12. In this respect, it has been ascertained that it is advantageous to employ relatively high pressure air at substantially the end of the pour cycle or shot of the mixhead nozzle 16 and a lesser air pressure during the remainder of the cycle which is sufficient to keep the orifice 21 of cylindrical barrel 17 clear during the pour shot of the mixhead nozzle 16 and to preclude orifice 65 formed by the cap 60 from becoming clogged.

In an operational instance involving the exemplary apparatus 10, these objectives were achieved by adjusting air valve 80 to supply 80 psi for a three-quarter second interval in the operating cycle of mixhead nozzle 16. In relation to the operating cycle of the mixhead nozzle 16, the 80 psi air flow was maintained for one-quarter of a second during the end of the operating cycle of the clean-out plunger 23 and one-half second with the clean-out plunger 23 in the fully down position depicted in FIG. 2, where it resides at the end of the pour cycle. This high pressure air emanating from orifice 65 of nozzle attachment 10 provides a high velocity, high thrust air flow which is substantially radial and axisymmetric about the pour nozzle orifice 21 and clears any foam residing thereon. The released foam is collected centrally of the mixhead nozzle 16 and then directed downwardly into an open mold as detailed hereinabove.

The air valve 80 is operative to a second position to supply 20 psi air to orifice 65 of the nozzle attachment 10, during the remainder of the operating cycle of the mixhead assembly 12. This lower pressure air is sufficient to maintain the entire area of mixhead nozzle 16 and nozzle attachment 10 free from spurious foam which may exist in the nozzle area. The low pressure air output by the nozzle attachment 10 is particularly significant during the shot segment of the pour cycle when random foam spraying can occur. Thus, the low pressure air maintains a continual cleaning tendency to preclude the attachment of foam to mixhead nozzle 16, with the short burst of high pressure air at the end of the clean-out plunger cycle to assure that any residual foam material is removed at that time.

It will, of course, be appreciated that the pressure of both the high pressure air and the low pressure air supplied to nozzle attachment 10 and the cyclic operation and intervals thereof will vary, depending upon the characteristics of a particular foam material, as well as the exact geometric configuration of the nozzle attachment 10. In particular, the size of the orifice 65 and the plenum chamber 52, as well as the resistance to air flow therethrough, constitute factors which will be material to the velocity of air exiting through the orifice 65. In this respect, adjustment of the cap 60 relative to sleeve 30 will be material in controlling the size of the orifice 65 and consequently the air-flow rate, velocity, and thrust force.

Thus, it should be evident that the cleaning attachment for nozzles disclosed herein carries out various of the objects of the invention as set forth above and otherwise constitutes an advantageous contribution to the art. As may be apparent to persons skilled in the art, modifications can be made to the preferred embodiment disclosed herein without departing from the spirit of the invention, the scope of the invention being limited solely by the scope of the attached claims.

What is claimed is:

1. A nozzle assembly for cleaning residual material from a mixhead pour nozzle having a cylindrical body terminating in an end face with an axial bore comprising, a plunger movable in the axial bore, sleeve means positioned outwardly of the cylindrical body forming a plenum chamber, port means in said sleeve means communicating said plenum chamber with a source of pressurized fluid, and cap means positioned circumferentially of the end face of the pour nozzle and providing an annular substantially radially inwardly directed orifice means communicating with the plenum chamber for directing pressurized fluid inwardly across the end face of the pour nozzle and said plunger to remove residual material therefrom.

2. A nozzle assembly according to claim 1, wherein said orifice means is radially inwardly converging.

3. A nozzle assembly according to claim 1, wherein said orifice means is formed between said cap means and the end face of the mixhead pour nozzle.

4. A nozzle assembly according to claim 1, wherein said cap means has a substantially radially inwardly directed lip means.

5. A nozzle assembly according to claim 4, wherein said lip means radially overlies a portion of the end face of the mixhead pour nozzle.

6. A nozzle assembly according to claim 4, wherein said lip means has an inside surface positioned at an angle of approximately 15° to a radial orientation, whereby said high pressure fluid is radially and slightly axially directed for radially confining and axially displacing the residual material from the mixhead pour nozzle.

7. A nozzle assembly according to claim 6, wherein said inside surface is coated with a composite of electroless nickel and polytetrafluoroethylene to prevent accumulation of the residual material thereon.

8. A nozzle assembly according to claim 6, wherein the mixhead pour nozzle has a beveled surface at the juncture of the cylindrical body and the end face which is progressively radially inwardly displaced a decreasing distance from said inside surface of said lip means.

9. A nozzle assembly according to claim 8, wherein said beveled surface is positioned at an angle of approximately 30° to a radial orientation.

10. A nozzle assembly according to claim 1, wherein said sleeve means has threads over a portion of the outer surface thereof and said cap means has threads over a portion of the inner surface thereof for engaging the threads on said sleeve means, whereby said cap means may be selectively manually adjusted for varying airflow rate, velocity, and thrust force and removed for cleaning.

11. A nozzle assembly according to claim 10, including fastener means in said cap means engaging the cylindrical body of the mixhead pour nozzle for maintaining said cap means in any selected position axially of the mixhead pour nozzle.

12. A nozzle assembly according to claim 1, wherein said plenum chamber is annular and extends substantially from said port means to said orifice means.

13. A nozzle assembly according to claim 12, wherein said annular plenum chamber has a width in the range of 0.06 to 0.07 of an inch, whereby an axisymmetric flow pattern of the high pressure fluid is maintained.

14. A nozzle assembly according to claim 1, wherein said port means is a pair of ports positioned at diametrically opposed locations on said sleeve means.

15. A nozzle assembly according to claim 14, wherein said pair of ports are through bores in said sleeve means directed radially thereof.

16. A nozzle assembly according to claim 1, wherein said pressurized fluid is air.

17. A nozzle assembly according to claim 16, including means for supplying relatively high pressure air to said port means at substantially the end of a pour cycle of the mixhead pour nozzle to remove any residual material deposited on the end face of the mixhead pour nozzle and said plunger.

18. A nozzle assembly according to claim 17, wherein said means for supplying relatively high pressure air to said port means supplies relatively low pressure air to said port means during the remainder of the pour cycle when relatively high pressure air is not being supplied to maintain said orifice means clear of the material.

19. A nozzle attachment for cleaning residual material from a mixhead pour nozzle having a cylindrical body terminating in an end face with an axial bore receiving a plunger comprising, sleeve means positioned outwardly of the cylindrical body forming a plenum chamber, port means in said sleeve means communicating said plenum chamber with a source of pressurized fluid, and cap means positioned circumferentially of the end face of the pour nozzle and providing an annular substantially radially inwardly directed orifice means communicating with the plenum chamber for directing pressurized fluid inwardly across the end face of the pour nozzle to remove residual material therefrom, said cap means having a substantially radially inwardly directed lip means, said lip means progressively tapering to a circular opening and being displaced a distance axially outwardly of the end face of the mixhead pour nozzle.

20. A mixhead pour nozzle for dispensing resin material comprising, a cylindrical body terminating in a radial end face with an axial bore receiving a movable plunger, sleeve means spaced outwardly of the cylindrical body forming a plenum chamber, port means in said sleeve means communicating said plenum chamber with a source of pressurized fluid, and cap means positioned circumferentially of the radial end face of the pour nozzle and providing an annular substantially radially inwardly directed orifice means communicating with the plenum chamber for directing pressurized fluid inwardly across the radial end face of the pour nozzle to remove residual material therefrom.

21. A mixhead pour nozzle according to claim 20, wherein said cap means has a substantially radially inwardly directed lip positioned axially outwardly of said radial end face.

* * * * *